US010215415B2

(12) United States Patent
Stewart

(10) Patent No.: US 10,215,415 B2
(45) Date of Patent: Feb. 26, 2019

(54) PREMIX FUEL NOZZLE ASSEMBLY CARTRIDGE

(71) Applicant: General Electric Company, Schenectady, NY (US)

(72) Inventor: Jason Thurman Stewart, Greer, SC (US)

(73) Assignee: General Electric Company, Schenectady, NY (US)

( * ) Notice: Subject to any disclaimer, the term of this patent is extended or adjusted under 35 U.S.C. 154(b) by 415 days.

(21) Appl. No.: 14/862,194

(22) Filed: Sep. 23, 2015

(65) Prior Publication Data

US 2017/0082290 A1 Mar. 23, 2017

(51) Int. Cl.

| | |
|---|---|
| ***F23R 3/28*** | (2006.01) |
| ***F23R 3/34*** | (2006.01) |
| ***F23R 3/12*** | (2006.01) |

(52) U.S. Cl.

CPC ..... *F23R 3/286* (2013.01); *F23R 3/12* (2013.01); *F23R 3/283* (2013.01); *F23R 3/343* (2013.01); *F05D 2260/202* (2013.01); *F23R 2900/03042* (2013.01); *F23R 2900/03343* (2013.01)

(58) Field of Classification Search

CPC .. F23R 3/12; F23R 3/286; F23R 3/343; F23R 2900/03343; F23R 3/283; F23D 11/106; F23D 11/107; F05D 2260/20; F05D 2260/202

See application file for complete search history.

(56) References Cited

U.S. PATENT DOCUMENTS

| | | | | |
|---|---|---|---|---|
| 5,862,668 | A * | 1/1999 | Richardson | F23D 23/00 60/737 |
| 6,446,439 | B1 | 9/2002 | Kraft et al. | |
| 6,609,380 | B2 | 8/2003 | Mick et al. | |
| 7,007,477 | B2 | 3/2006 | Widener | |
| 8,079,218 | B2 * | 12/2011 | Widener | F23D 14/48 60/737 |
| 8,347,631 | B2 | 1/2013 | Bailey et al. | |

(Continued)

FOREIGN PATENT DOCUMENTS

| | | | |
|---|---|---|---|
| WO | 2013/115671 A1 | 8/2013 | |
| WO | WO 2014/081334 | 5/2014 | |
| WO | WO 2015152760 A1 * | 10/2015 | F23R 3/28 |

OTHER PUBLICATIONS

Partial European Search Report and Opinion issued in connection with corresponding EP Application No. 16187997.8 dated Feb. 15, 2017.

(Continued)

*Primary Examiner* — Gerald L Sung
*Assistant Examiner* — Alain Chau
(74) *Attorney, Agent, or Firm* — Dority & Manning, P.A.

(57) ABSTRACT

A fuel nozzle assembly includes a centerbody and a cartridge that extends axially through the centerbody. The cartridge defines a purge air passage within the centerbody. The cartridge includes a tip portion that is defined by a tip body. The tip body defines a throat portion and a mouth portion which is defined downstream from the throat portion. The tip body further defines a plurality of injection ports circumferentially spaced around the throat portion. The injection ports provide for fluid communication between the purge air passage and the throat portion of the tip body.

13 Claims, 8 Drawing Sheets

(56) References Cited

U.S. PATENT DOCUMENTS

| | | | | |
|---|---|---|---|---|
| 2004/0006989 | A1* | 1/2004 | Stuttaford | F23R 3/286 60/776 |
| 2010/0293954 | A1* | 11/2010 | Widener | F23D 14/48 60/740 |
| 2011/0005229 | A1* | 1/2011 | Venkataraman | F23D 11/38 60/737 |
| 2011/0252803 | A1 | 10/2011 | Subramanian et al. | |
| 2013/0219899 | A1 | 8/2013 | Uhm et al. | |
| 2013/0312422 | A1 | 11/2013 | Westmoreland et al. | |
| 2014/0190168 | A1 | 7/2014 | Shershnyov et al. | |
| 2015/0135716 | A1* | 5/2015 | Ginessin | F23R 3/28 60/737 |
| 2015/0159875 | A1* | 6/2015 | Berry | F23R 3/286 60/737 |
| 2017/0241644 | A1 | 8/2017 | Cihlar et al. | |

OTHER PUBLICATIONS

Extended European Search Report and Opinion issued in connection with corresponding EP Application No. 16187997.8 dated Jun. 28, 2017.

Copending U.S. Appl. No. 14/555,074, Michael Christopher Gibson, filed Nov. 26, 2014.

Copending U.S. Appl. No. 14/555,143, Jason Thurman Stewart, filed Nov. 26, 2014.

Copending U.S. Appl. No. 14/688,170, Bryan Wesley Romig, filed Apr. 16, 2015.

* cited by examiner

PREMIX FUEL NOZZLE ASSEMBLY CARTRIDGE

FIELD OF THE INVENTION

The present invention generally involves a fuel nozzle assembly for a gas turbine combustor. More specifically, the invention relates to a cartridge for a premix fuel nozzle assembly.

BACKGROUND OF THE INVENTION

Gas turbines are widely used in industrial and power generation operations. A gas turbine generally includes, in serial flow order, a compressor, a combustion section and a turbine. The combustion section may include multiple combustors annularly arranged around an outer casing. In operation, a working fluid such as ambient air is progressively compressed as it flows through the compressor. A portion of the compressed working fluid is routed from the compressor to each of the combustors where it is mixed with a fuel and burned in a combustion zone to produce combustion gases. The combustion gases are routed through the turbine along a hot gas path where thermal and/or kinetic energy is extracted from the combustion gases via turbine rotors blades coupled to a rotor shaft, thus causing the rotor shaft to rotate and produce work and/or thrust.

Some combustion systems utilize a plurality of dual fuel premix type fuel nozzles. A dual fuel type fuel nozzle may be configured to provide a liquid fuel only, a gaseous fuel only or may be configured to provide both a liquid fuel and a gaseous fuel. This flexibility is typically accomplished by mounting or inserting an appropriate cartridge type through a center body portion of the fuel nozzle. For example, a cartridge may be configured to provide liquid fuel, gaseous fuel and/or may be configured to provide a purge medium such as compressed air through the center body. For gas turbines which have no provision to run liquid fuel and are as such "gas only", gas only cartridges are placed in the center body of the fuel nozzles. The gas only cartridges must be cooled as well as purged so that the hot combustion gases are not allowed into the cartridge cavity.

In particular combustors, at least one of the fuel nozzles may include a premix pilot tip or nozzle. During particular combustion operation modes, the premix pilot nozzle may deliver a premixed fuel and air mixture to the combustion zone to produce a pilot flame. The pilot flame is generally used to ensure flame stability as the combustor is operated in certain modes and/or when the combustor transitions between various modes of operation. Unstable flames have a high susceptibility to undesirable fluctuations in heat release. The base of the pilot flame typically resides adjacent to or just downstream from an exit face of the premix pilot nozzle. As a result, the exit face is exposed to extremely high temperatures.

The premix pilot nozzle is typically disposed at a distal end of the center body upstream from the combustion zone. In certain configurations, a portion of the gas only cartridge extends through the premix pilot nozzle. A tip portion of the gas only cartridge and a tip portion the premixed pilot nozzle may be substantially planar along their exit faces. As a result, purge air flowing from the cartridge may negatively impact pilot flame stability.

Known cartridges may create strong jets of air at their exit face which may cause pilot flame instability. In addition, the premixed pilot nozzles may create a high temperature environment at the planar faces of the cartridge and the premixed pilot nozzle. Accordingly, an improved fuel nozzle that reduces flame instability while providing cooling to the exit faces of the premix pilot nozzle and/or the gas only cartridge would be useful in the art.

BRIEF DESCRIPTION OF THE INVENTION

Aspects and advantages of the invention are set forth below in the following description, or may be obvious from the description, or may be learned through practice of the invention.

One embodiment of the present invention is a fuel nozzle assembly. The fuel nozzle assembly includes a centerbody and a cartridge that extends axially through the centerbody. The cartridge defines a purge air passage within the centerbody. The cartridge includes a tip portion that is defined by a tip body. The tip body defines a throat portion and a mouth portion which is defined downstream from the throat portion. The tip body further defines a plurality of injection ports circumferentially spaced around the throat portion. The injection ports provide for fluid communication between the purge air passage and the throat portion of the tip body. The injection ports are oriented with respect to a centerline that extends through the tip body such that the injector ports impart angular swirl to a compressed air flowing from the purge air passage into the throat portion.

Another embodiment of the present disclosure is a fuel nozzle assembly. The fuel nozzle assembly includes a centerbody and an outer tube that is coaxially aligned with and at least partially surrounds the centerbody. The centerbody and the outer tube are radially spaced to form an annular passage therebetween. A plurality of struts extends radially between the centerbody and the outer tube within the annular passage. The fuel nozzle assembly further includes a premix pilot nozzle that is disposed at a downstream end of the centerbody and a cartridge that extends axially through the centerbody and at least partially through a cartridge opening defined by the premix pilot nozzle. The cartridge defines a purge air passage within the centerbody. The cartridge includes a tip portion that is defined by a tip body. The tip body defines a throat portion and a mouth portion that is defined downstream from the throat portion. The tip body further defines a plurality of injection ports circumferentially spaced around the throat portion. The injection ports provide for fluid communication between the purge air passage and the throat portion.

Another embodiment of the present disclosure is a combustor. The combustor includes an end cover and a plurality of fuel nozzle assemblies extending downstream from an inner surface of the end cover. At least one fuel nozzle assembly includes a centerbody and a cartridge that extends axially through the centerbody. The cartridge defines a purge air passage within the centerbody. The cartridge includes a tip portion that is defined by a tip body. The tip body defines a throat portion and a mouth portion which is defined downstream from the throat portion. The tip body further defines a plurality of injection ports which are circumferentially spaced around the throat portion. The injection ports provide for fluid communication between the purge air passage and the throat portion and are oriented with respect to a centerline that extends through the tip body such that the injector ports impart angular swirl to a compressed air flowing from the purge air passage into the throat portion.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
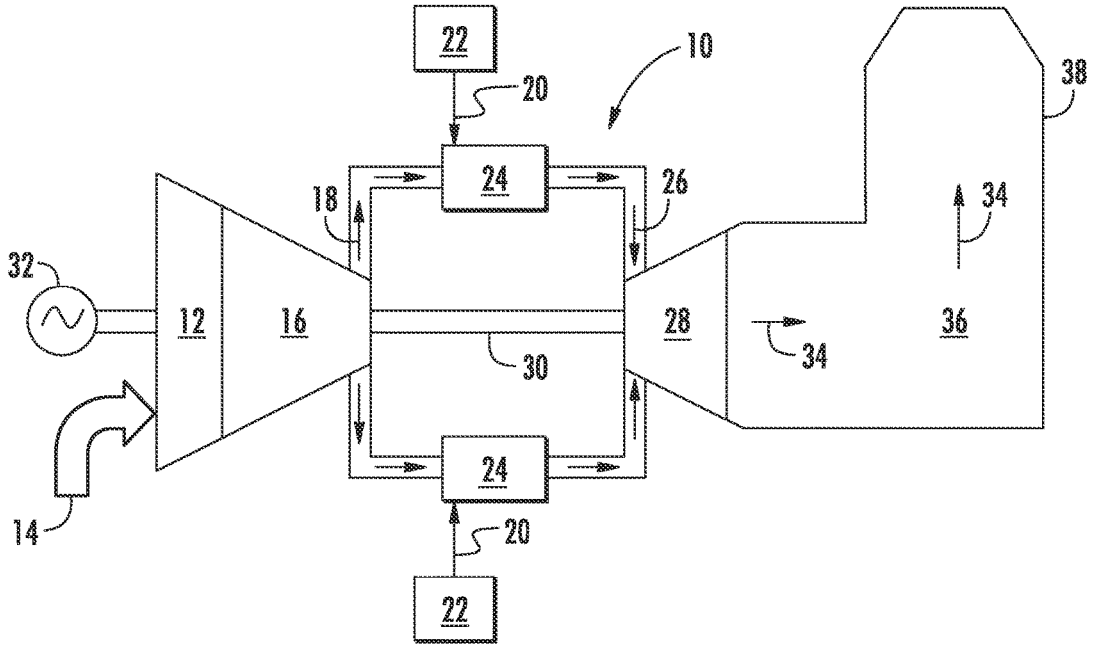
FIG. 1 PRIOR ART
FIG. 1 is a functional block diagram of an exemplary gas turbine that may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel and/or coaxially aligned to an axial centerline of a particular component.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Although exemplary embodiments of the present invention will be described generally in the context of a fuel nozzle assembly for a land based power generating gas turbine combustor for purposes of illustration, one of ordinary skill in the art will readily appreciate that embodiments of the present invention may be applied to any style or type of combustor for a turbomachine and are not limited to combustors or combustion systems for land based power generating gas turbines unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition air 14 or other working fluid entering the gas turbine 10. The air 14 flows to a compressor section where a compressor 16 progressively imparts kinetic energy to the air 14 to produce compressed air 18.

The compressed air 18 is mixed with a fuel 20 from a fuel supply system 22 to form a combustible mixture within one or more combustors 24. The combustible mixture is burned to produce combustion gases 26 having a high temperature, pressure and velocity. The combustion gases 26 flow through a turbine 28 of a turbine section to produce work. For example, the turbine 28 may be connected to a shaft 30 so that rotation of the turbine 28 drives the compressor 16 to produce the compressed air 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
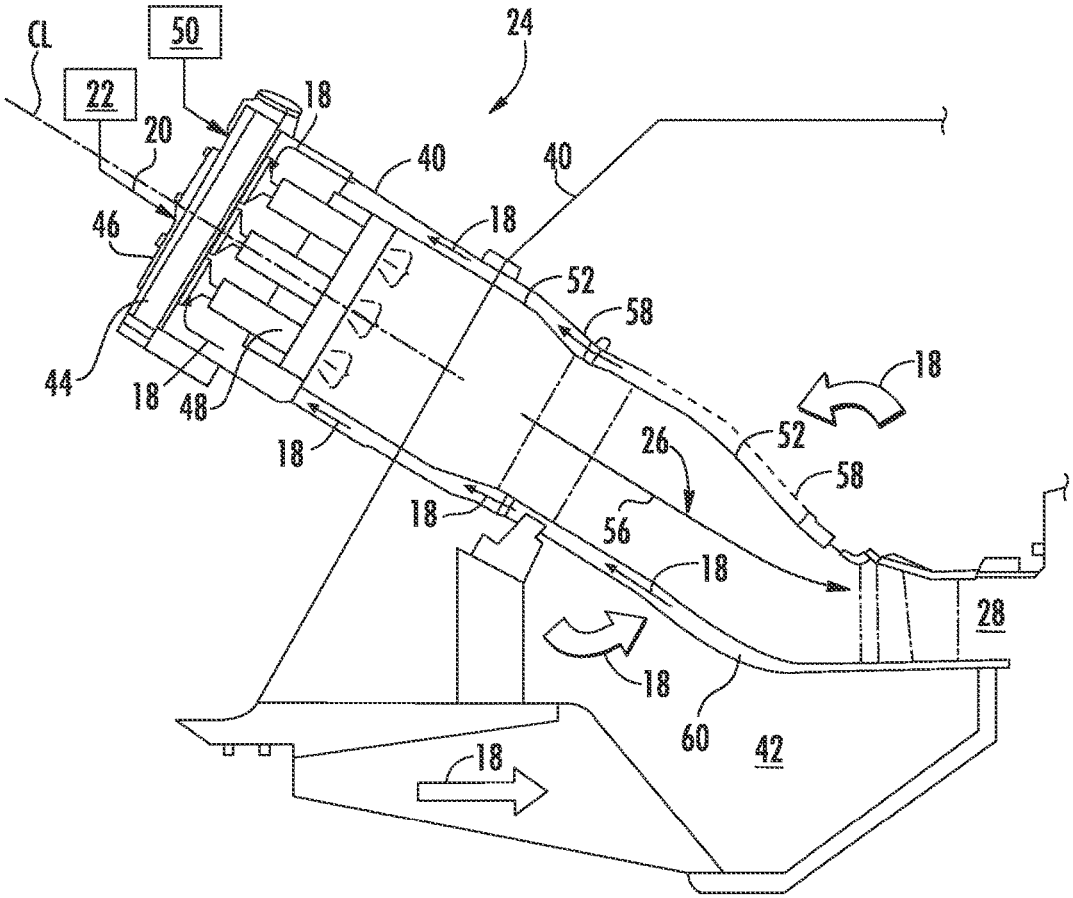
FIG. 2 is a side view of an exemplary combustor as may incorporate various embodiments of the present invention.

The combustor 24 may be any type of combustor known in the art, and the present invention is not limited to any particular combustor design unless specifically recited in the claims. For example, the combustor 24 may be a can-annular or an annular combustor. FIG. 2 provides a perspective side view of a portion of an exemplary combustor 24 as may be incorporated in the gas turbine 10 shown in FIG. 1 and as may incorporate one or more embodiments of the present invention.

In an exemplary embodiment, as shown in FIG. 2, the combustor 24 is at least partially surrounded by an outer casing 40 such as a compressor discharge casing. The outer casing 40 may at least partially define a high pressure plenum 42 that at least partially surrounds the combustor 24. The high pressure plenum 42 is in fluid communication with the compressor 16 (FIG. 1) so as to receive the compressed air 18 therefrom. An end cover 44 may be coupled to the outer casing 40. The outer casing 40 and the end cover 44 may at least partially define a head end portion 46 of the combustor 24.

One or more fuel nozzles 48 extend axially downstream from the end cover 44 within and/or through the head end 46. At least some of the fuel nozzles 48 may be in fluid communication with the fuel supply system 22 via the end cover 44. In particular embodiments, at least one of the fuel nozzles 48 may be in fluid communication with a purge or cooling air supply 50 for example, via the end cover 44.

The combustor 24 may also include one or more liners 52 such as a combustion liner and/or a transition duct that at least partially define a combustion chamber or reaction zone 54 within the outer casing 40. The liner(s) 52 may also at least partially define a hot gas path 56 for directing the combustion gases 26 into the turbine 28. In particular configurations, one or more flow or impingement sleeves 58 may at least partially surround the liner(s) 52. The flow sleeve(s) 58 may be radially spaced from the liner(s) 52 so as to define an annular flow path 60 for directing a portion of the compressed air 18 towards the head end portion 46 of the combustor 24.

Figure 3:
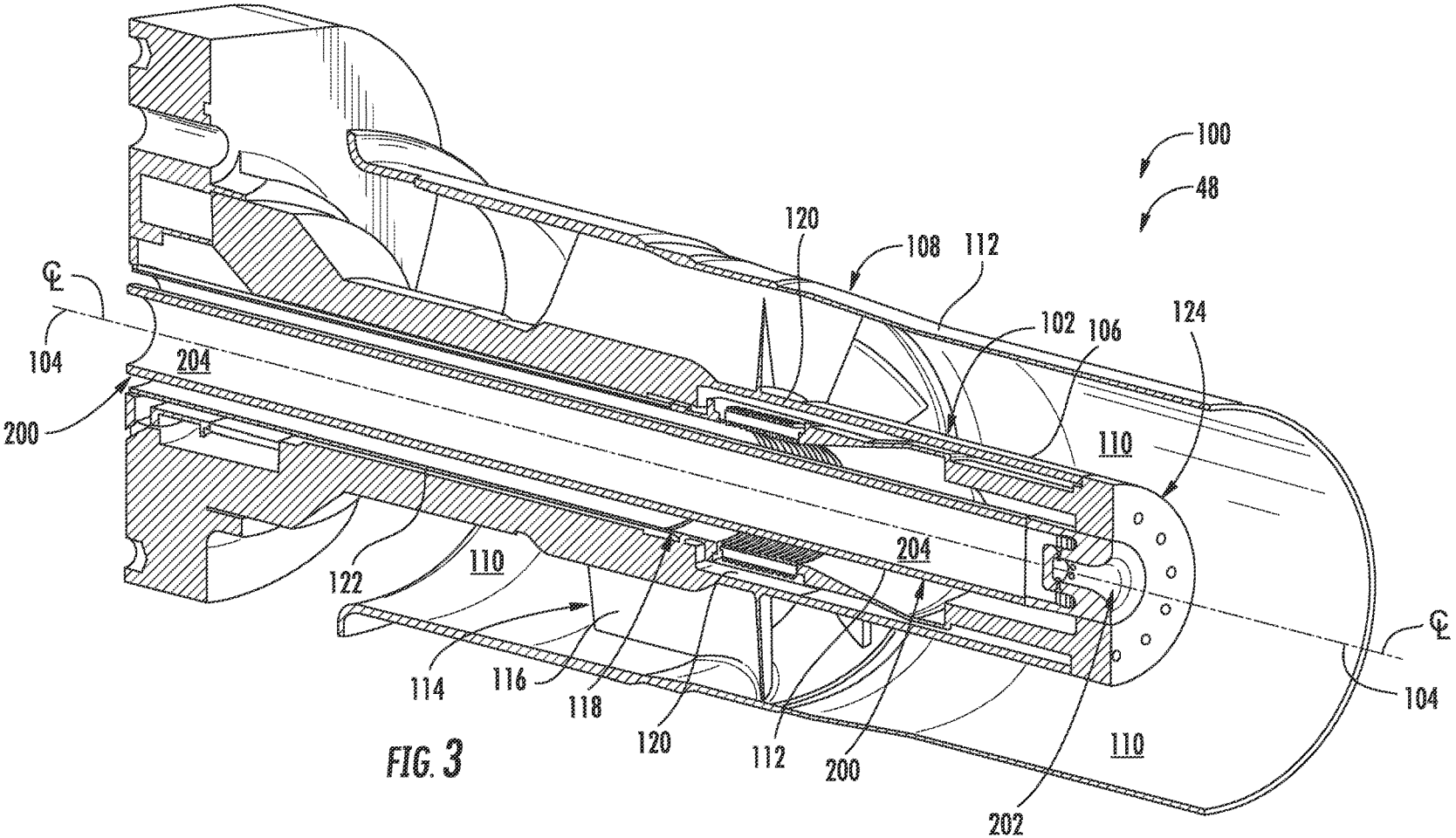
FIG. 3 is a perspective cross sectioned side view of a an exemplary fuel nozzle assembly as may incorporate one or more embodiments of the present invention.

FIG. 3 provides a perspective cross sectioned side view of an exemplary dual-fuel premix type fuel nozzle assembly 100 according to one or more embodiments of the present invention and as may be incorporated into the combustor 24 as shown in FIG. 2. Fuel nozzle assembly 100 may be representative of one, any or all of the fuel nozzles 48 shown in FIG. 2 and is not limited to any particular location or position along the end cover 44 or within the combustor 24 unless otherwise recited in the claims. In particular embodiments, the fuel nozzle assembly 100 may be configured or modified to burn or operate on either a gaseous fuel or a liquid fuel or both.

As shown in FIG. 3, the fuel nozzle assembly 100 generally includes a tube shaped center body 102 that extends axially along a center line 104. The center body 102 may be formed from one or more coaxially aligned sleeves or tubes 106. In particular embodiments, the center body 102 extends axially within an outer tube or sleeve 108. The outer tube 108 is radially spaced from the center body 102 so as to define an annular passage 110 therebetween. The outer tube 108 may be formed from one or more coaxially aligned tubes or sleeves 112.

A plurality of turning vanes or struts 114 may extend radially and axially between the center body 102 and the outer tube 108 within the flow passage 110. The turning vanes 114 may include one or more fuel ports 116 for injecting a fuel into the premix flow passage 110. In certain operational modes, a portion of the compressed air 18 from the high pressure plenum 42 enters the annular passage 110 of the fuel nozzle assembly 100 where the swirler vanes 114 impart angular swirl to the compressed air 18 as it flows through the annular passage 110. A gaseous fuel such as natural gas is injected into the flow of compressed air 18. The gaseous fuel mixes with the compressed air 18 in the annular passage 110 upstream from the reaction zone 54 (FIG. 2). The premixed fuel and air exits the annular passage 110, enters the reaction zone 54 and is combusted to provide the combustion gases 26.

In particular embodiments, as illustrated in FIG. 3, an inner tube or sleeve 118 may extend axially within the center body 102 with respect to centerline 104. The inner tube 118 is radially spaced from the center body 102 so as to define a pilot fuel circuit 120 therebetween within the center body 102. The inner tube 118 may be formed from one or more coaxially aligned tubes or sleeves 122. In particular embodiments, the fuel nozzle assembly 100 includes a premix pilot nozzle or tip 124. The premix pilot nozzle 124 is disposed at downstream end portion 126 of the center body 102.

Figure 4:
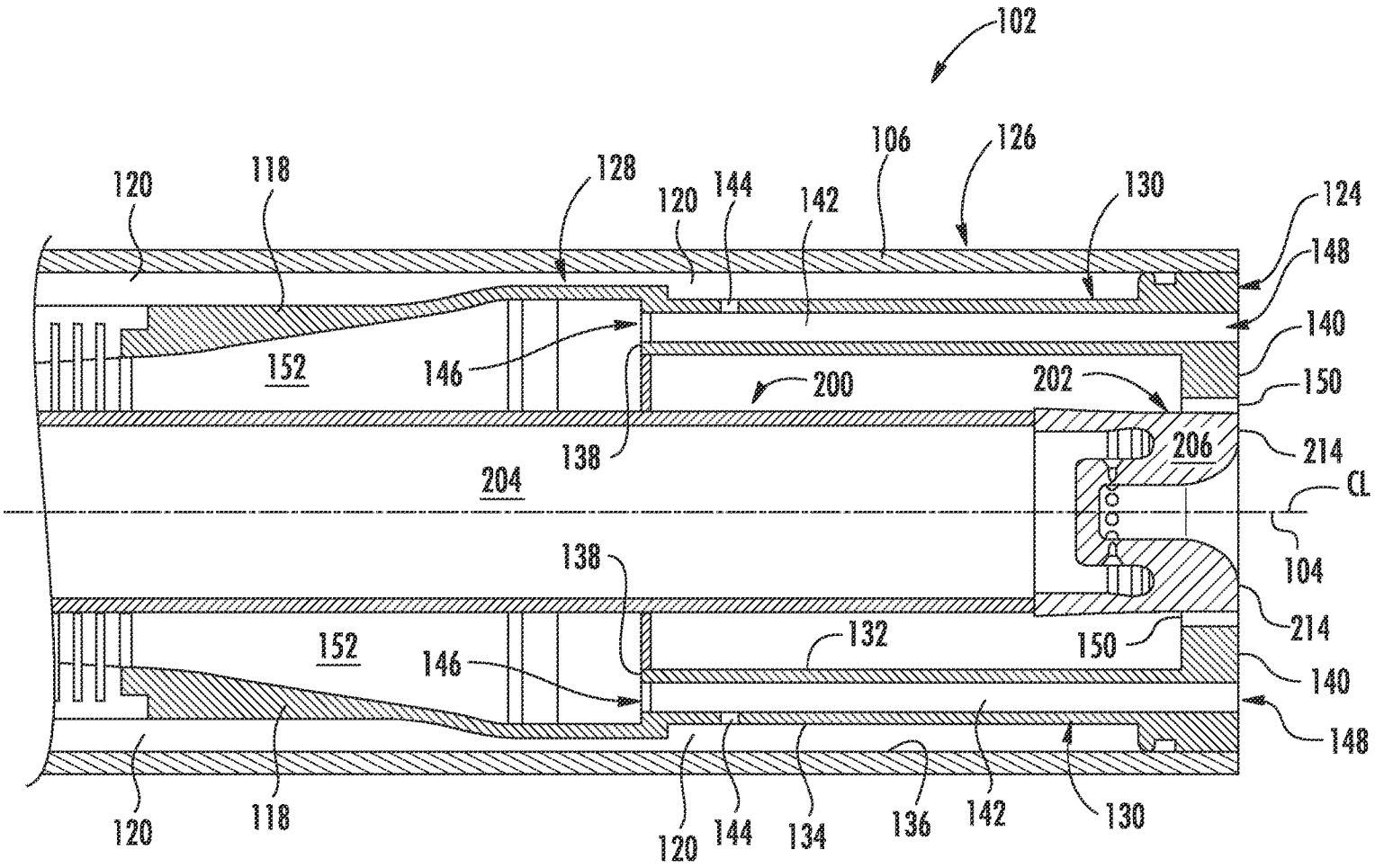
FIG. 4 is an enlarged cross sectioned side view of a portion of the fuel nozzle assembly taken along section line 4-4 as shown in FIG. 3, according to at least one embodiment of the present invention.
Figure 5:
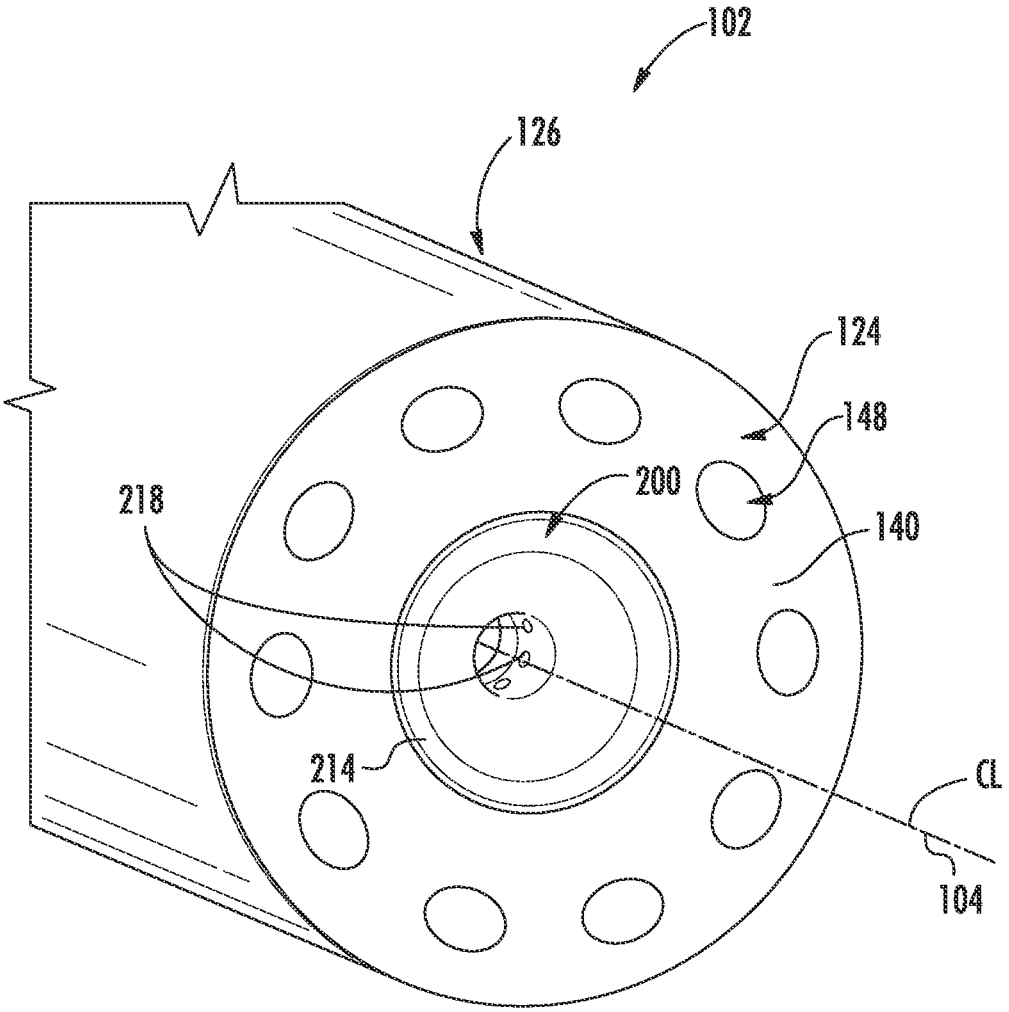
FIG. 5 is an enlarged perspective view of a portion of a centerbody of the fuel nozzle assembly as shown in FIG. 3, according to at least one embodiment of the present invention.

FIG. 4 provides an enlarged cross sectioned side view of a portion of the center body 102 as taken along section line 4-4 in FIG. 3, according to at least one embodiment. FIG. 5 provides a perspective view of a portion of the center body 102 including the premix pilot nozzle 124 according to at least one embodiment.

In particular embodiments, as shown in FIG. 4, the premix pilot nozzle 124 may be annular or substantially annular and may extend axially downstream from a downstream end 128 of the inner tube 118. In various embodiments, the premix pilot nozzle 124 includes a plurality of premix tubes 130 annularly arranged about or around the centerline 104. The premix tubes 130 may be defined or disposed radially between an inner wall 132 and an outer wall 134 of the premix pilot nozzle 124. The outer wall 134 and an inner wall 136 of the center body 102 partially define and/or are in fluid communication with the pilot fuel circuit 120. Each premix tube 130 extends between and through a forward or upstream radial wall 138 and a downstream radial wall or exit face 140 of the premix pilot nozzle 124. Each premix tube 130 defines a premix flow passage 142 through the premix pilot nozzle 124. Each or at least some of the premix tubes 130 may include one or more fuel ports 144 which provide for fluid communication between the pilot fuel circuit 120 and a corresponding premix flow passage 142.

As shown in FIG. 4, each premix tube 130 includes an inlet 146 that is at least partially defined along the upstream radial wall 138 of the premix pilot nozzle 124. As shown in FIGS. 4 and 5, each premix tube 130 also includes an outlet 148 that is defined along the exit face 140. As shown in FIG. 5, the outlets 148 may be angled or configured with respect to centerline 104 so as to impart angular swirl about centerline 104 to a fuel/air mixture flowing from the premix flow passages 142 of the corresponding premix tubes 130. In various embodiment, the premix pilot nozzle 124 defines a cartridge opening 150 coaxially aligned with centerline 104.

Figure 6:
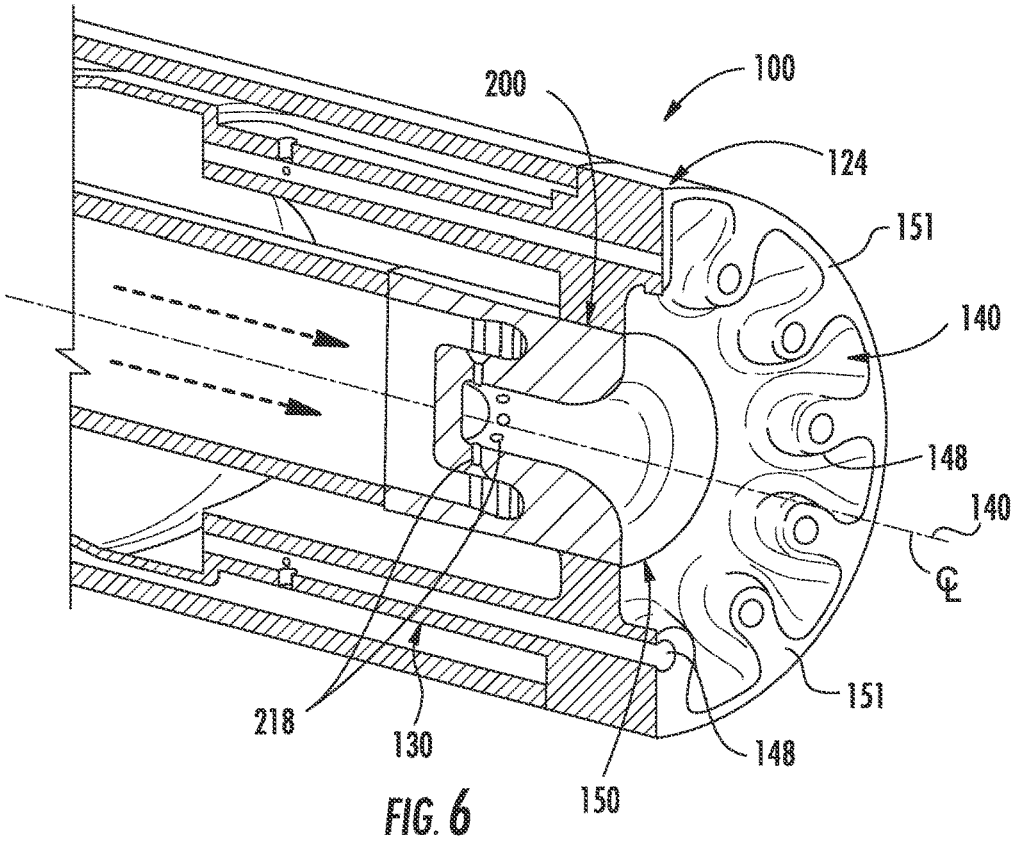
FIG. 6 is an enlarged perspective view of a portion of a centerbody of the fuel nozzle assembly as shown in FIG. 3, according to at least one embodiment of the present invention.
Figure 7:
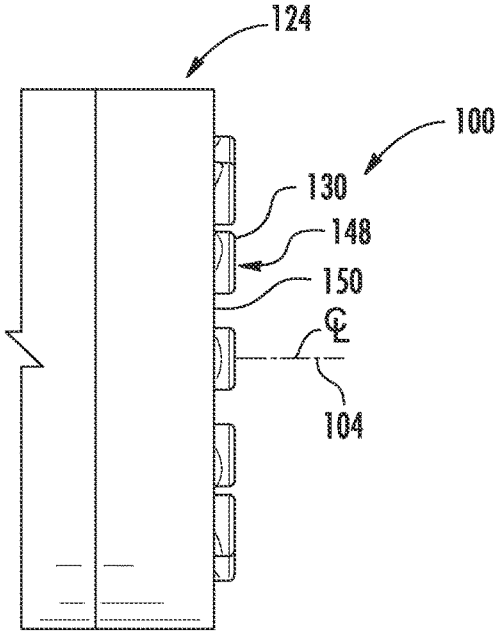
FIG. 7 is a side view of a portion of the centerbody as shown in FIG. 6, according to one embodiment of the present invention.

FIG. 6 is a perspective view of a portion of the premix pilot nozzle 124 according to a second embodiment of the fuel nozzle assembly 100. As shown in FIG. 6, the downstream radial wall or exit face 140 may be curved or cupped in an axial direction with respect to centerline 104 such that at least a portion of the downstream radial wall 140 is substantially curvilinear and/or has a curvilinear cross sectional profile. In various embodiments, as shown in FIG. 6, the outlet 148 of each premix tube 130 terminates axially downstream or is axially offset from the cartridge opening 150 of the premix pilot nozzle 124. In particular embodiments as shown in FIG. 6, at least one of the premix tubes 130 terminates substantially adjacent to or within a common radial plane of a downstream end 151 of the premix pilot nozzle 124. In alternate embodiments, as shown in FIG. 7, at least one of the premix tubes 130 terminates at a point that is axially downstream or axially offset from the downstream end 151 of the premix fuel nozzle 124 with respect to centerline 104.

In various embodiments, as shown collectively in FIGS. 3, 4, 5 and 6, the fuel nozzle assembly 100 includes a cartridge 200. The cartridge 200 may comprise a gas only cartridge, an air purge cartridge or the like. In one embodiment, the cartridge 200 is a gas-only type cartridge. In particular configurations, the cartridge 200 may be breech loaded through the end cover 44 (FIG. 2).

In at least one embodiment, as shown in FIGS. 3 and 4 collectively, the cartridge 200 extends axially within the inner tube 118 with respect to centerline 104. A tip portion 202 of the cartridge 200 extends at least partially through the cartridge opening 150 defined in the downstream radial wall 140 of the premix pilot nozzle 124. As shown in FIGS. 3 and 4, the cartridge 200 at least partially defines a purge or cooling air passage 204 within the fuel nozzle assembly 100. The purge air passage 204 may be in fluid communication with the purge air supply 50 (FIG. 2). In various embodiments, as shown in FIGS. 3 and 4, the cartridge 200 is radially spaced from the inner tube 118 and at least partially defines a premix air passage 152 therebetween. In various embodiments, as shown most clearly in FIG. 4, the inlets 146 of the premix tubes 130 may be in fluid communication with the premix air passage 152.

Figure 8:
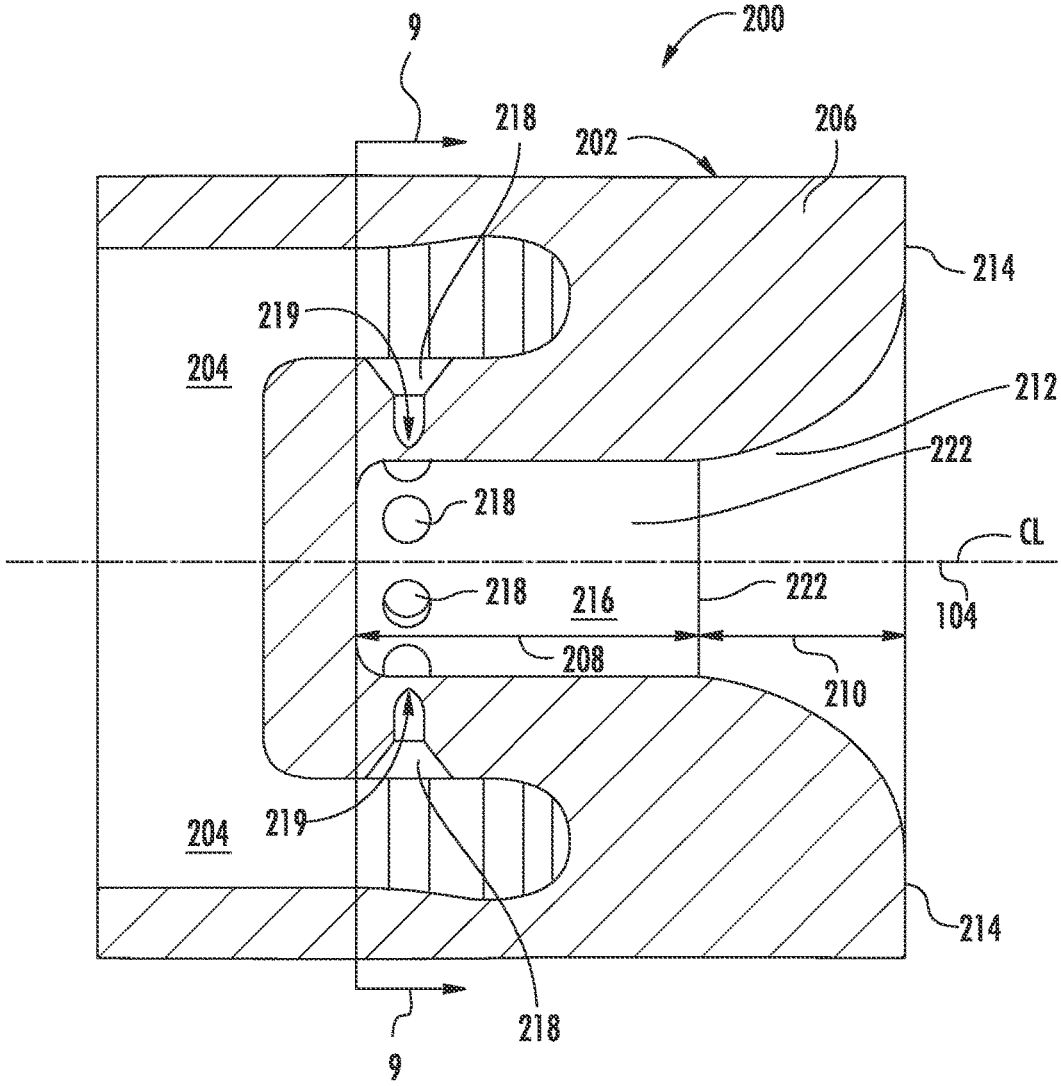
FIG. 8 is an enlarged cross sectioned side view of a portion of a cartridge portion of the fuel nozzle assembly as shown in FIGS. 3 and 4, according to at least one embodiment of the present invention.

FIG. 8 provides an enlarged cross sectioned side view of a portion of the cartridge 200 as shown in FIG. 4, according to at least on embodiment of the present invention. As shown in FIG. 8, the tip portion 202 of the cartridge 200 is formed from a tip body 206. The tip body 206 includes and/or at least partially defines a throat portion 208 and a mouth portion 210. The throat portion 208 and the mouth portion 210 form an outer surface 212 of the tip body 206. The throat portion 208 is defined axially inwardly with respect to centerline 104 from an exit face or surface 214 of the tip body 206. In particular embodiments, the throat portion 208 and the mouth portion 210 collectively define a swirling chamber 216 of the tip body 206. In particular embodiments, as shown in FIGS. 4 and 5, the exit face 214 of the tip body 206 may be planar or substantially planar with the exit face 140 of the premix pilot nozzle 124.

Figure 9:
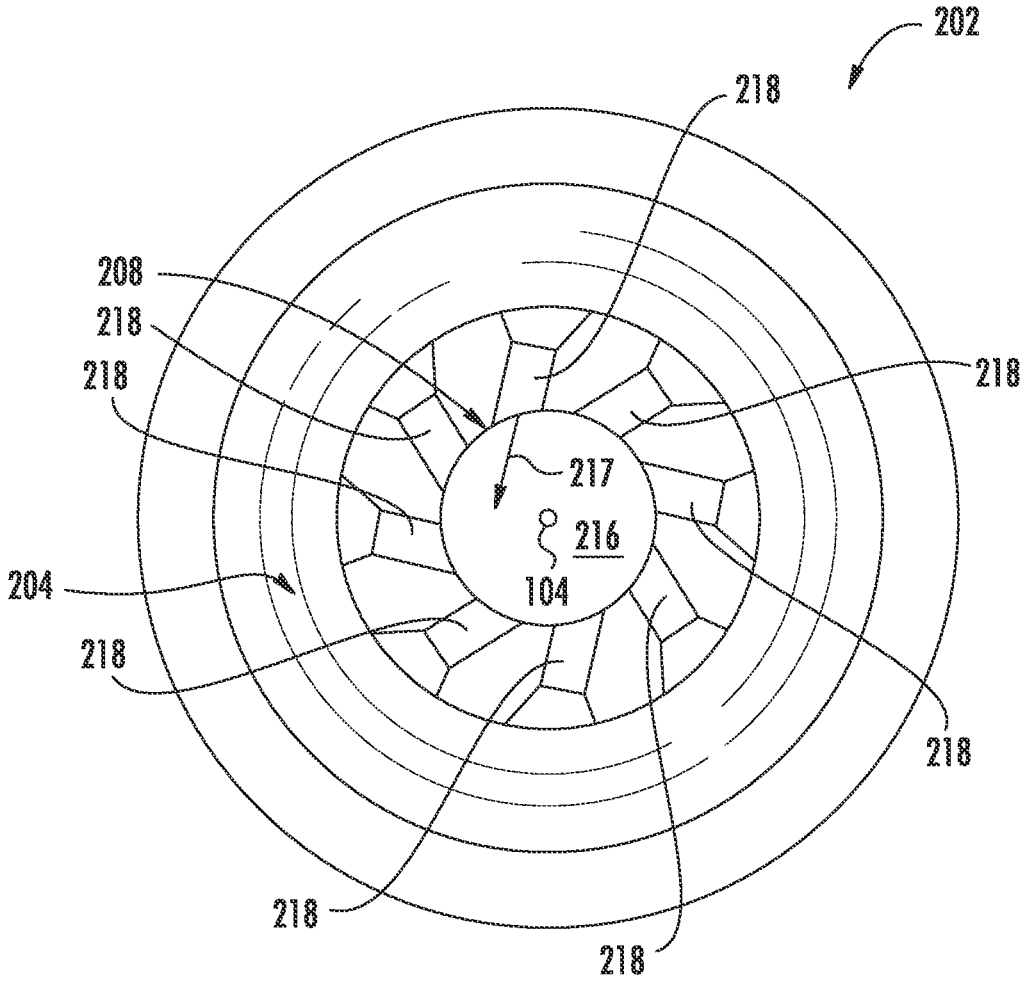
FIG. 9 is an enlarged cross sectioned downstream view of the cartridge as taken along section line 9-9 as shown in FIG. 8, according to at least one embodiment of the present invention.

FIG. 9 provides a cross sectioned downstream view of the tip portion 202 of the cartridge 200 as taken along section line 9-9 in FIG. 8, according to at least one embodiment of the present invention. In various embodiments, as shown in FIGS. 8 and 9, the tip body 206 also includes a plurality of injection ports 218 positioned or defined along the throat portion 208. The injection ports 218 are circumferentially spaced around the throat portion 208. The injection ports 218 provide for fluid communication between the purge air passage 204 and the throat portion 208 of the tip body 206. The injection ports 218 extend radially inwardly with respect to centerline 104. One or more of the injection ports 218 is/are angled or oriented with respect to centerline 104 so as to impart angular swirl about centerline 104 to a compressed fluid such as air as indicated schematically by arrows 219 as it enters the throat portion 208 and the swirling chamber 216 of the tip body 206. An inlet portion or hole lead-in portion of one or more of the injection ports may be chamfered or have a radius to allow the compressed fluid 219 to attach to the surface of the corresponding injection port 218 for the full circumference, without large recirculation zones, and therefore take on the flow direction of the injection port 218 so that the intended swirl is generated.

In particular embodiments, as shown in FIG. 8, the throat portion 208 may be cylindrical or substantially cylindrical. The throat portion 208 extends axially between an upstream wall 220 of the tip body 206 and the mouth portion 210. Although shown in FIG. 8 as cylindrically shaped, it is to be understood that the throat portion 208 may take other shapes as well and should not be limited to a cylindrical shape unless otherwise recited in the claims. For example, the throat portion 208 may be at least partially conical.

In various embodiments, the mouth portion 210 extends from an intersection 222 with the throat portion 208 to the exit face 214 of the tip body 206. In particular embodiments, as illustrated in FIG. 8, the mouth portion 210 may be bell or substantially bell shaped. In particular embodiments, the mouth portion 210 is formed as or by a circular arc of constant radius. At least a portion of the mouth portion 210 diverges radially outwardly along centerline 104 from a point at or proximate to the intersection 222 with the throat portion 208. In particular embodiments, the mouth portion 210 and/or portion of the outer surface 212 associated with or formed by the mouth portion 210 may be curved or extend in the axial direction in a curvilinear fashion. For example, the mouth portion 210 and/or portion of the outer surface 212 associated with or formed by the mouth portion 210 may have a hyperbolic or exponential curved shape.

Now referring to FIGS. 2-9 collectively, during piloted premix operation of the fuel nozzle assembly 100, premix air flows from the premix air passage 152 into the premix flow passages 142 of the premix tubes 130 via inlets 146. Fuel from the pilot fuel circuit 120 is injected into the premix flow passages 142 via fuel ports 144 where it mixes with the fuel before being ejected from the outlets 148 towards the reaction zone 54. The premixed fuel/air is burned thus creating a premix pilot flame (not shown). A base portion of the premix pilot flame generally resides at or proximate to the outlets 148.

Air 217 flows from the purge air passage 204 into the throat portion 208 of the tip body 206 via injection ports 218. The radial and angular orientation of the injection ports 218 with respect to centerline 104 causes the air 217 to flow radially inwardly and to swirl about centerline 104 within the swirling chamber 216. The swirling air then flows axially outwardly from the throat portion 208 along the outer surface 212 and into the mouth portion 210. As the swirling air flows across the outer surface 212 formed by the mouth portion 210, a flow field of the swirling air expands radially outwardly. The swirling air then flows across the exit face 214 of the tip body 206, thus providing convection cooling and a protective layer, or film of air to the cartridge tip body 206. At least a portion of the swirling air may also flow across and/or around the base of each pilot flame and at least a portion of the exit face 140 of the premix pilot nozzle 124, thus providing cooling thereto.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fuel nozzle assembly, comprising:

a centerbody;

a cartridge that extends axially through the centerbody, the cartridge defining a purge air passage within the centerbody, the cartridge having a tip portion defined by a tip body, the tip body defining a throat portion and a mouth portion defined downstream from the throat portion, the throat portion having a cylindrical portion with a closed upstream end thereby defining the throat portion as a cup-shape, and the throat portion and the mouth portion defining a continuous radially inward facing surface, the mouth portion diverging radially outward from an intersection with the throat portion with respect to a centerline that extends through the tip body forming the mouth portion as a bell-shaped opening at a downstream end of the centerbody, the tip body further defining a plurality of injection ports circumferentially spaced around the throat portion through the cylindrical portion, wherein the injection ports provide for fluid communication between the purge air passage and the throat portion, and wherein the injection ports are oriented with respect to a centerline that extends through the tip body such that the injector ports impart angular swirl to a compressed air flowing from the purge air passage into the throat portion, said compressed air exiting the tip body through the bell-shaped opening; and a premix pilot nozzle disposed at a downstream end of the centerbody and that extends axially through the centerbody, wherein the premix pilot nozzle comprises a plurality of circumferentially spaced premix tubes disposed radially outward of the tip body with respect to the centerline, each premix tube having an inlet defined along an upstream wall, an outlet defined along an exit face of the premix pilot nozzle and a premix passage defined therebetween, each premix tube further comprising a fuel port in fluid communication with a premix fuel circuit defined within the centerbody, wherein the inlets are in fluid communication with a premix air passage defined within the centerbody, and wherein the outlet of each premix tube is angled with respect to the centerline to impart angular swirl about the centerline to a fuel/air mixture flowing from the premix passages of the corresponding premix tubes.

2. The fuel nozzle assembly as in claim 1, wherein the throat portion and the mouth portion define a swirl chamber within the tip body.

3. The fuel nozzle assembly as in claim 1, wherein at least a portion of the mouth portion has a hyperbolic or exponential shape.

4. The fuel nozzle assembly as in claim 1, further comprising a premix pilot nozzle disposed at a downstream end of the centerbody and that extends axially through the centerbody, wherein an exit face of the tip body is planar with an exit face of the premix pilot nozzle.

5. The fuel nozzle assembly as in claim 1, wherein the cartridge is a gas-only type cartridge.

6. A fuel nozzle assembly, comprising:

a centerbody;

an outer tube coaxially aligned with and at least partially surrounding the centerbody, wherein the centerbody and the outer tube are radially spaced to form an annular passage therebetween;

a plurality of struts that extend radially between the centerbody and the outer tube within the annular passage;

a premix pilot nozzle disposed at a downstream end of the centerbody; and a cartridge that extends axially through the centerbody and at least partially through a cartridge opening defined by the premix pilot nozzle, the cartridge defining a purge air passage within the centerbody, the cartridge having a tip portion defined by a tip body, the tip body defining a throat portion and a mouth portion defined downstream from the throat portion, the throat portion having a cylindrical portion with a closed upstream end thereby defining the throat portion as a cup-shape, and the throat portion and the mouth portion defining a continuous radially inward facing surface, the mouth portion diverging radially outward from an intersection with the throat portion with respect to a centerline that extends through the tip body forming the mouth portion as a bell-shaped opening at a downstream end of the centerbody, the tip body further defining a plurality of injection ports circumferentially spaced around the throat portion through the cylindrical portion, wherein the injection ports provide for fluid communication between the purge air passage and the throat portion, said compressed air exiting the tip body through the bell-shaped opening;

wherein the premix pilot nozzle comprises a plurality of circumferentially spaced premix tubes disposed radially outward of the tip body with respect to the centerline, each premix tube having an inlet defined along an upstream wall, an outlet defined along an exit face of the premix pilot nozzle and a premix passage defined therebetween, each premix tube further comprising a fuel port in fluid communication with a premix fuel circuit defined within the centerbody, wherein the inlets are in fluid communication with a premix air passage defined within the centerbody.

7. The fuel nozzle assembly as in claim 6, wherein the plurality of injection ports are oriented with respect to a centerline that extends through the tip body such that the injector ports impart angular swirl to a compressed air flowing from the purge air passage into the throat portion.

8. The fuel nozzle assembly as in claim 6, wherein the throat portion and the mouth portion define a swirl chamber within the tip body.

9. The fuel nozzle assembly as in claim 6, wherein at least a portion of the mouth portion has a hyperbolic or an exponential shape.

10. The fuel nozzle assembly as in claim 6, wherein an exit face of the tip body is planar with an exit face of the premix pilot nozzle.

11. The fuel nozzle assembly as in claim 6, wherein the cartridge is a gas-only type cartridge.

12. A combustor, comprising:

an end cover;

a plurality of fuel nozzle assemblies extending downstream from an inner surface of the end cover, wherein at least one fuel nozzle assembly comprises:

a centerbody;

a cartridge that extends axially through the centerbody, the cartridge defining a purge air passage within the centerbody, the cartridge having a tip portion defined by a tip body, the tip body defining a throat portion and a mouth portion defined downstream from the throat portion, the throat portion having a cylindrical portion with a closed upstream end thereby defining the throat portion as a cup-shape, and the throat portion and the mouth portion defining a continuous radially inward facing surface, the mouth portion diverging radially outward from an intersection with the throat portion with respect to a centerline that extends through the tip body forming the mouth portion as a bell-shaped opening at a downstream end of the centerbody, the tip body further defining a plurality of injection ports circumferentially spaced around the throat portion through the cylindrical portion, wherein the injection ports provide for fluid communication between the purge air passage and the throat portion, and wherein the plurality of injection ports are oriented with respect to a centerline that extends through the tip body such that the injector ports impart angular swirl to a compressed air flowing from the purge air passage into the throat portion, said compressed air exiting the tip body through the bell-shaped opening; and a premix pilot nozzle disposed at a downstream end of the centerbody and that extends axially through the centerbody, wherein the premix pilot nozzle comprises a plurality of circumferentially spaced premix tubes disposed radially outward of the tip body with respect to the centerline, each premix tube having an inlet defined along an upstream wall, an outlet defined along an exit face of the premix pilot nozzle and a premix passage defined therebetween, each premix tube further comprising a fuel port in fluid communication with a premix fuel circuit defined within the centerbody, wherein the inlets are in fluid communication with a premix air passage defined within the centerbody.

13. The combustor as in claim 12, wherein the mouth portion diverges radially outwardly in a curvilinear fashion.

* * * * *